US006029474A

United States Patent [19]

Bunz

[11] Patent Number: 6,029,474

[45] Date of Patent: Feb. 29, 2000

[54] POLISHED GEMSTONE

[75] Inventor: Georg Bunz, Dobei, Germany

[73] Assignee: Atelier Bunz GmbH, Dobel, Germany

[21] Appl. No.: 09/125,194

[22] PCT Filed: Jan. 30, 1997

[86] PCT No.: PCT/DE97/00196

§ 371 Date: Aug. 13, 1998

§ 102(e) Date: Aug. 13, 1998

[87] PCT Pub. No.: WO97/29661

PCT Pub. Date: Aug. 21, 1997

[30] Foreign Application Priority Data

Feb. 19, 1996 [DE] Germany ..... 196 05 876

[51] Int. Cl.[7] ..... A44C 17/00

[52] U.S. Cl. ..... 63/32; D11/89; D11/90

[58] Field of Search ..... 63/32; D11/89, D11/90

[56] References Cited

U.S. PATENT DOCUMENTS

| | | | |
|---|---|---|---|
| D. 244,367 | 5/1977 | Saltzman | D11/90 |
| D. 250,640 | 12/1978 | Grossbard | D11/90 |
| D. 297,718 | 9/1988 | Cohen et al. | D11/90 |
| D. 324,003 | 2/1992 | Baranes | D11/90 |
| D. 350,708 | 9/1994 | Bachar | D11/90 |
| D. 362,204 | 9/1995 | Eknes | D11/90 |
| D. 384,592 | 10/1997 | Siman-Tov et al. | D11/90 |
| D. 393,230 | 4/1998 | Katz | D11/90 |
| D. 398,552 | 9/1998 | Siman-Tov et al. | D11/90 |
| D. 400,817 | 11/1998 | Ambar | D11/90 |
| D. 402,226 | 12/1998 | Wolf | D11/90 |
| D. 402,582 | 12/1998 | Ambar | D11/89 |

FOREIGN PATENT DOCUMENTS

| | | |
|---|---|---|
| 1557625 | 2/1972 | Germany . |
| 2720267 | 12/1977 | Germany . |
| 3202302 | 8/1983 | Germany . |
| 4210995 | 10/1993 | Germany . |

*Primary Examiner*—Terry Lee Melius
*Assistant Examiner*—Andrea Chop
*Attorney, Agent, or Firm*—Pillsbury Madison & Sutro

[57] ABSTRACT

A gemstone, on which respectively at least four facets of equal size have been cut in the upper part and the lower part above and below the girdle plane, which have a parallel base edge, wherein the angle (α) between an upper part facet (20 . . . 23) and the girdle plane is less than the angle (β) between a lower part facet (10 . . . 13) and the girdle plane. Between the lateral edges of the lower part facets (10, 11, 12, 13) one group (40 . . . 43) of narrow, triangular additional facets, which extend fan-like from a girdle plane, is provided. The narrow sides of the one group of additional facets meet in the connecting lines between the tips of the lower part facets (10, 11, 12, 13) and the narrow sides of the additional facets of a respectively neighboring group.

8 Claims, 2 Drawing Sheets

POLISHED GEMSTONE

BACKGROUND OF THE INVENTION

1. Field of the Invention

The invention relates to a gemstone on which respectively at least four facets of equal size have been cut in the upper part and the lower part above and below a girdle plane, which have a parallel base edge, wherein the angle between an upper part facet and the girdle plane is less than the angle between a lower part facet and the girdle plane.

2. Prior Art

Such a cut of a gemstone is known, for example, from DE-PS 15 57 625, wherein an equal number of facets on the upper part and facets on the lower part determine the appearance and its optical properties.

A comparable cut is known from DE 42 10 995 A1, wherein it is intended that particular angles between the facets on the upper part and facets on the lower part lead to a particularly noticeable appearance, essentially by planar effects which differ in their brightness.

A further development of these types of cuts is shown in DE 32 02 302 A1, wherein outer facets include the girdle plane.

Finally, DE 27 20 267 C2 shows a diamond, which has a very complex structure of cut surfaces, among them also narrow triangular facets which, combined into groups, widen in a fan shape from the area close to the top of the diamond down to circumferential lateral facets. In its optical effects, the interplay of the multitude of different facets also leads to a complex, rather confusing appearance.

BRIEF SUMMARY OF THE INVENTION

It is the object of the invention to apply a cut which offers a novel appearance regarding brilliance and lightness effects while maintaining the basic shape of the diamond crystal.

In accordance with the invention, this object is attained by a gemstone composed of an upper part and a lower part, said upper and lower parts being disposed at respectively opposite sides of a girdle plane, wherein:

- said upper part consists of a plurality of upper part facets of equal size, each upper part facet forming a first angle ($\alpha$) with the girdle plane;
- said lower part comprises a plurality of lower part facets each having two lateral edges that extend away from the girdle plane and meet at a tip that is remote from the girdle plane, each lower part facet forming a second angle ($\beta$) with the girdle plane, the first angle ($\alpha$) being less than the second angle ($\beta$);
- said tips of said lower part facets are spaced from one another and said lower part is formed to have connecting lines between said tips;
- said lower part further comprises a plurality of groups of narrow, triangular additional facets that fan out from the girdle plane, each group being located between lateral edges of a respective pair or said lower part facets;
- each of said additional facets has a narrow side which coincides with a segment of one of the connecting lines; and
- the narrow side of each additional facet of one group meets the narrow side of one additional facet of a respective neighboring group.

When observing the gemstone from the top, the fan-like extending group of additional facets at the lower part leads to a reflection for the observer such that, per facet surface, a rayor star-shaped light effect occurs on the four pyramid-shaped facets of the upper part, which is in contrast to the so far known rather planar light effects in connection with the types of cuts mentioned at the outset.

The quadruple bundling of the light in this case leads to the appearance of reflections, which penetrate the total surface of the diamond several times.

Advantageous embodiments of the attainment of the object of the invention ensue from the dependent claims.

BRIEF DESCRIPTION OF THE SEVERAL VIEWS OF THE DRAWINGS

A preferred embodiment will be explained in still more detail by means of the drawings. Shown are in.

DETAILED DESCRIPTION OF THE INVENTION

Figure 1:
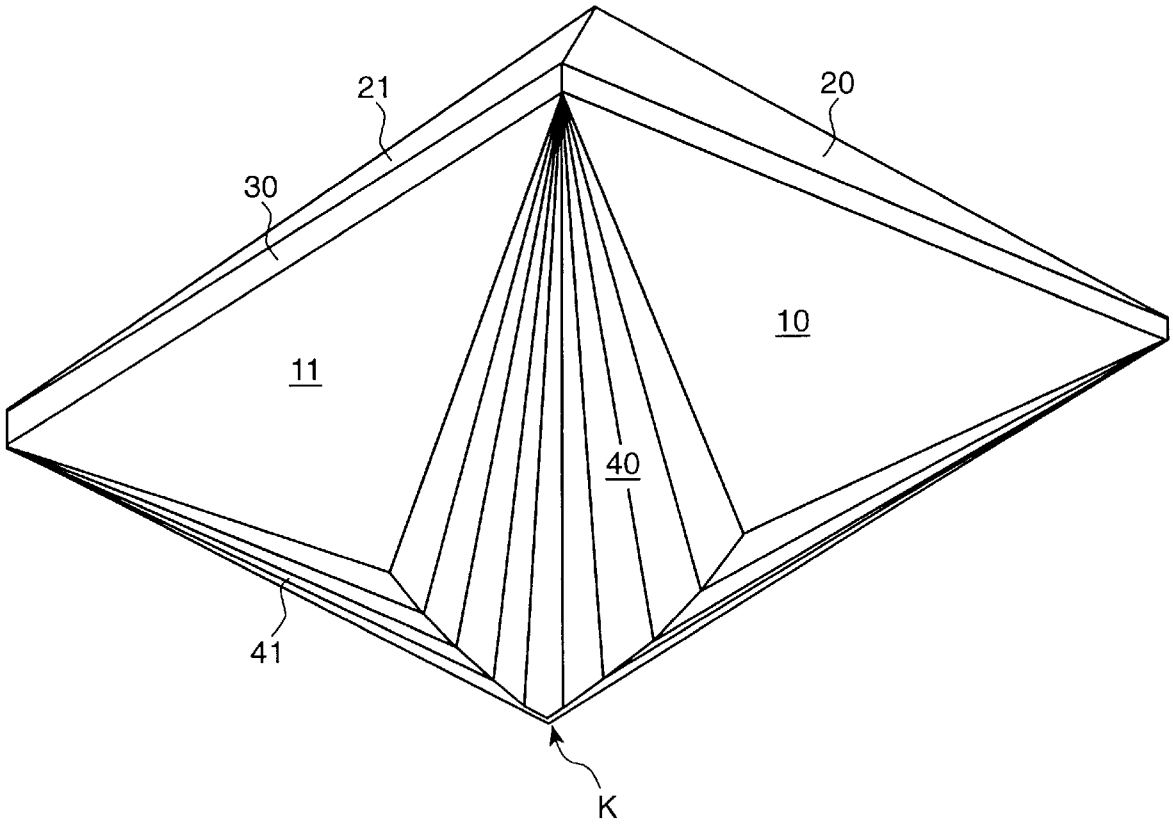
FIG. 1, a perspective plan view of the cut gemstone obliquely from below.
Figure 2:
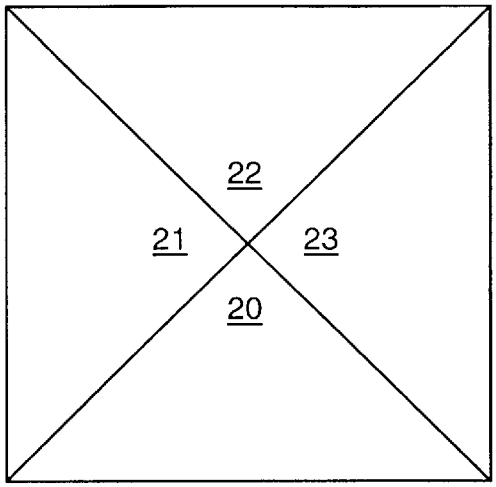
FIG. 2, a top view of the gemstone in the direction of the arrow A in FIG. 3, FIG. 3, a lateral view of the gemstone in the direction of the arrow C in FIG. 4, and FIG. 4, a bottom view of the gemstone in the direction of the arrow B in FIG. 3.
Figure 3:
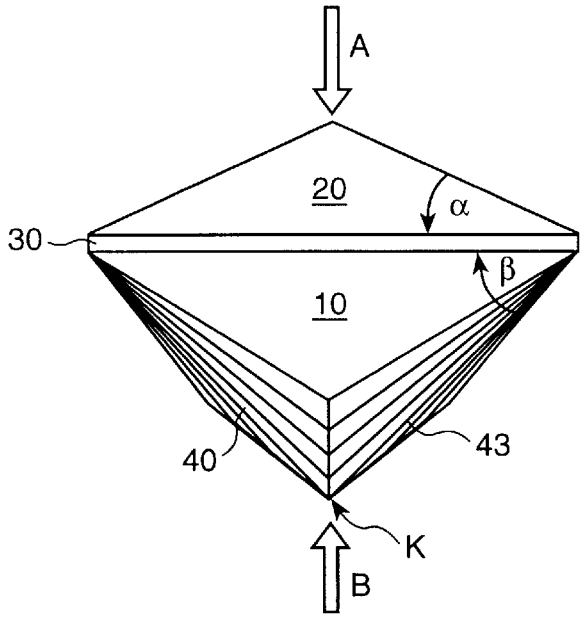
Figure 4:
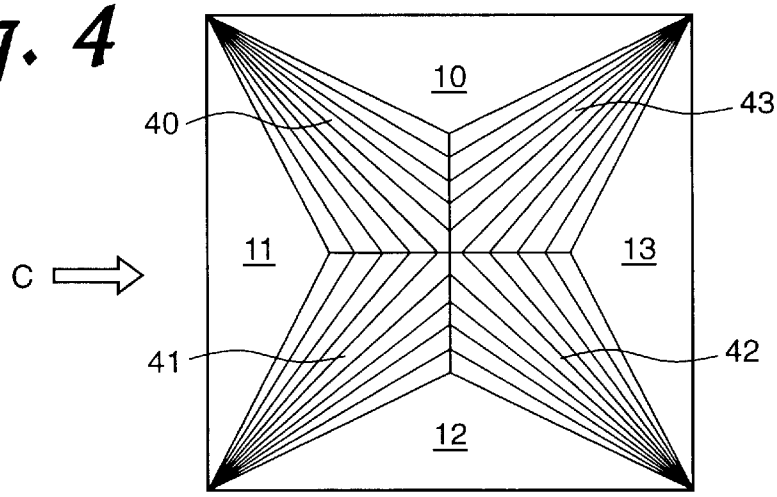

The upper portion of the gemstone, which consists of four top part facets 20 . . . 23 of equal size, which taper to form an upper cap, rises above the square girdle plane. Here the top part facet forms an isosceles triangle. The girdle plane may also be circular.

The lower part of the diamond contains four lower part facets 10 . . . 13, which also form an isosceles triangle.

The common base side of the upper part facets and lower part facets is formed by a circumferential facet band 30 perpendicularly in respect to the girdle plane.

Four groups 40 . . . 43 of narrow, essentially triangular additional facets extend from the four corners of the girdle plane between the lateral edges of the lower part facets 10 . . . 13 in such a way that their narrow sides meet in the connecting lines between the tips of lower parts facets 10 . . . 13 with the narrow sides of the additional facets of the respectively neighboring group. Here each group consists of a central additional facet, whose roof-like narrow sides form a pyramid-shaped cap K of the lower part, and which, in the exemplary embodiment represented, are adjoined by respectively four narrow triangular additional facets on both sides. With the exemplary embodiment represented, the central additional facet is also embodied as a narrow triangle, but it is also possible (not represented) to provide the central additional facet with parallel lateral edges, so that in its effect it approximately corresponds to the circumferential facet band 30. The planes of neighboring additional facets are inclined at a very acute angle in respect to each other, so that in the exemplary embodiment represented, the 36 additional facets close the gemstone at the bottom is the shape of a cupola between the lower part facets 10 . . . 13.

Depending on the type of gemstone, the angle $\alpha$ between each of the upper part facets 20 . . . 23 and the girdle plane lies between 23° and 30°, the angle $\beta$ between the each of lower part facets 10 . . . 13 and the girdle plane lies between 34° and 43°.

Each group 40–43 of additional facets is preferably formed of at least three additional facets whose longitudinal sides enclose an angle of approximately 5° to 15°. The appearance of a gemstone cut in this way is essentially determined by the cupola-like arrangement of the additional facets, which, because of the multitude of occurring angles of inclination and diffraction, mirrors a lively optical image on the upper part facets when light enters evenly from below, and is characterized by evenly arranged or distributed star-like light effects, which in their geometry actively reproduce the naturally provided geometry of the gemstone.

I claim:

1. A gemstone composed of an upper part and a lower part, said upper and lower parts being disposed at respectively opposite sides of a girdle plane, wherein:

said upper part consists of a plurality of upper part facets of equal size, each upper part facet forming a first angle ($\alpha$) with the girdle plane;

said lower part comprises a plurality of lower part facets each having two lateral edges that extend away from the girdle plane and meet at a tip that is remote from the girdle plane, each lower part facet forming a second angle ($\beta$) with the girdle plane, the first angle ($\alpha$) being less than the second angle ($\beta$);

said tips of said lower part facets are speaded from one another and said lower part is formed to have connecting lines between said tips;

said lower part further comprises a plurality of groups of narrow, triangular additional facets that fan out from the girdle plane, each group being located between lateral edges of a respective pair or said lower part facets;

each of said additional facets has a narrow side which coincides with a segment of one of the connecting lines; and the narrow side of each additional facet of one group meets the narrow side of one additional facet of a respective neighboring group.

2. The gemstone in accordance with claim 1, characterized in that the angle ($\alpha$) between each one of the upper part facets (20 . . . 23) and the girdle plane is 23° to 30°.

3. The gemstone in accordance with claim 1, characterized in that the angle ($\beta$) between each one of the lower part facets (10 . . . 13) and the girdle plane is 34° to 43°.

4. The gemstone in accordance with claim 1, characterized in that each group (40 . . . 43) of additional facets is formed of at least three additional facets, each additional facet having longitudinal sides which enclose an angle of approximately 5° to 15°.

5. The gemstone in accordance with claim 4, characterized in that each group of additional facets includes a central additional facet having two narrow sides, the narrow sides of said central additional facets form a pyramid-shaped cap of said lower part, and said central additional facet of each said group is adjoined at each side by at least one other additional facet.

6. The gemstone in accordance with claim 1, characterized in that the planes of neighboring additional facets are inclined toward each other at an angle of approximately 1° to 3°, so that the total of at least twelve additional facets close off the gemstone in an approximately cupola-shaped manner at the bottom.

7. The gemstone in accordance with claim 1, characterized in that the girdle plane has a circumferential facet band (30).

8. The gemstone in accordance with claim 1, characterized in that the girdle plane is square.

* * * * *